US011073171B2

(12) United States Patent
Kondo et al.

(10) Patent No.: US 11,073,171 B2
(45) Date of Patent: Jul. 27, 2021

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Makoto Itoh, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/623,192

(22) PCT Filed: Jun. 14, 2018

(86) PCT No.: PCT/JP2018/022707

§ 371 (c)(1),
(2) Date: Dec. 16, 2019

(87) PCT Pub. No.: WO2018/230636

PCT Pub. Date: Dec. 20, 2018

(65) Prior Publication Data

US 2020/0158143 A1 May 21, 2020

(30) Foreign Application Priority Data

Jun. 14, 2017 (JP) ..... JP2017-116525

(51) Int. Cl.
*F15B 11/042* (2006.01)
*F15B 11/05* (2006.01)
(Continued)

(52) U.S. Cl.
CPC ..... *F15B 11/042* (2013.01); *F15B 11/05* (2013.01); *F15B 13/026* (2013.01); *F15B 13/0433* (2013.01); *F15B 2211/50536* (2013.01)

(58) Field of Classification Search
CPC ..... F15B 11/042; F15B 11/05; F15B 13/026; F15B 13/0433; F15B 2211/50536; F15B 2211/6346; F15B 2211/6652
See application file for complete search history.

(56) References Cited

U.S. PATENT DOCUMENTS 5,074,194 A * 12/1991 Hirata ..... E02F 9/2235 91/525
5,394,697 A * 3/1995 Hirata ..... E02F 9/2235 60/426

(Continued)

FOREIGN PATENT DOCUMENTS

JP 01141203 A * 6/1989
JP H01-141203 A 6/1989

(Continued)

*Primary Examiner* — Thomas E Lazo
(74) *Attorney, Agent, or Firm* — Oliff PLC

(57) ABSTRACT

A hydraulic system includes: an operation device that outputs an operation signal corresponding to an operating amount of an operating unit; a variable displacement pump that supplies hydraulic oil to a hydraulic actuator; a control valve interposed between the actuator and pump, the control valve changing a meter-in opening area thereof, so an increase rate of the opening area increases in accordance with increase in the operation signal; a regulator that adjusts a tilting angle of the pump; an unloading valve that defines an unloading flow rate, at which the hydraulic oil is released to a tank; and a controller that, when the operation device is operated, determines a control valve required flow rate so rate is proportional to the meter-in opening area of the control valve, and controls the regulator so a discharge flow rate of the pump is a sum of the control valve and unloading flow rates.

3 Claims, 3 Drawing Sheets

(51) Int. Cl.
*F15B 13/02* (2006.01)
*F15B 13/043* (2006.01)

(56) References Cited

U.S. PATENT DOCUMENTS 6,526,747 B2 * 3/2003 Nakatani ..... E02F 9/22 60/399
6,895,852 B2 * 5/2005 Pieper ..... E02F 9/2225 60/422
7,168,246 B2 * 1/2007 Toji ..... E02F 9/2228 60/468

FOREIGN PATENT DOCUMENTS

JP 2004-138187 A 5/2004
JP 2005-180570 A 7/2005

* cited by examiner

HYDRAULIC SYSTEM

TECHNICAL FIELD

The present invention relates to a hydraulic system of an electrical positive control type.

BACKGROUND ART

Conventionally, construction machines and industrial machines adopt a hydraulic system of an electrical positive control type (see Patent Literature 1, for example). Generally speaking, in a hydraulic system, hydraulic oil is supplied from a variable displacement pump to a hydraulic actuator via a control valve, and the tilting angle of the pump is adjusted by a regulator. In a hydraulic system of an electrical positive control type, a controller controls the regulator, such that the discharge flow rate of the pump increases in accordance with increase in the operating amount of an operation device intended for moving the hydraulic actuator.

CITATION LIST

Patent Literature

PTL 1: Japanese Laid-Open Patent Application Publication No. 2004-138187

SUMMARY OF INVENTION

Technical Problem

As shown in FIG. 6, the discharge flow rate of the pump in the hydraulic system of an electrical positive control type linearly changes in proportion to the operating amount of the operation device. Meanwhile, the opening area of a meter-in opening that functions as a restrictor of the control valve changes in a curvilinear manner, such that the increase rate of the opening area increases in accordance with increase in the operating amount of the operation device.

Generally speaking, the slope of a straight line as shown in FIG. 6, the straight line defining the discharge flow rate of the pump in relation to the operating amount of the operation device, is determined based on the maximum value of the meter-in opening area of the control valve. Accordingly, when the operating amount of the operation device is less than the maximum amount (i.e., when the operation device is not fully operated), the discharge flow rate of the pump becomes excessively high relative to the meter-in opening area of the control valve, and energy consumed for driving the pump is wasted.

In view of the above, an object of the present invention is to provide a hydraulic system that makes it possible to suppress wasteful energy consumption when the operating amount of the operation device is less than the maximum amount.

Solution to Problem

In order to solve the above-described problems, a hydraulic system of the present invention includes: at least one operation device that outputs an operation signal corresponding to an operating amount of an operating unit; a variable displacement pump that supplies hydraulic oil to at least one hydraulic actuator; at least one control valve interposed between the hydraulic actuator and the pump, the control valve changing a meter-in opening area thereof, such that an increase rate of the meter-in opening area increases in accordance with increase in the operation signal outputted from the operation device; a regulator that adjusts a tilting angle of the pump; an unloading valve that defines an unloading flow rate, at which the hydraulic oil discharged from the pump is released to a tank; and a controller that, when the operation device is operated, determines a control valve required flow rate such that the control valve required flow rate is proportional to the meter-in opening area of the control valve, and controls the regulator such that a discharge flow rate of the pump is a sum of the control valve required flow rate and the unloading flow rate.

According to the above configuration, if the unloading flow rate is not taken into account, when the operation device is operated, the discharge flow rate of the pump changes at the same change rate as that of the meter-in opening area of the control valve. That is, regardless of the operating amount of the operation device, the discharge flow rate of the pump will not become excessively high relative to the meter-in opening area of the control valve. Thus, wasteful energy consumption can be suppressed when the operating amount of the operation device is less than the maximum operating amount.

The control valve required flow rate, which is obtained by subtracting the unloading flow rate from the discharge flow rate of the pump, is also a flow rate passing through the meter-in opening of the control valve. Since the control valve required flow rate is proportional to the meter-in opening area, a value obtained by dividing the control valve required flow rate by the meter-in opening area is constant. The square of the value obtained by dividing the control valve required flow rate by the meter-in opening area is proportional to the pressure difference between the upstream-side pressure and the downstream-side pressure of the meter-in opening. That is, in the present invention, the pressure difference between the upstream-side pressure and the downstream-side pressure of the meter-in opening can be kept constant. Therefore, even though the hydraulic system is of an electrical positive control type, the same control as in a case where the hydraulic system is of a load-sensing type can be performed.

The at least one operation device may include a plurality of operation devices. The at least one hydraulic actuator may include a plurality of hydraulic actuators. The at least one control valve may include a plurality of control valves. The above hydraulic system may further include pressure compensation valves, each pressure compensation valve being provided downstream of a meter-in opening of a corresponding one of the plurality of control valves, the meter-in opening functioning as a restrictor of the corresponding control valve, each pressure compensation valve keeping constant a pressure difference between a downstream-side pressure of the meter-in opening and a highest load pressure among load pressures of the plurality of respective hydraulic actuators. In a case where no pressure compensation valve is installed, when some of the plurality of operation devices are operated concurrently, the supply of the hydraulic oil is concentrated to the hydraulic actuator with a lower load. On the other hand, in a case where the pressure compensation valves are installed, when some of the plurality of operation devices are operated concurrently, the hydraulic oil can be supplied to the hydraulic actuators in respective distribution amounts corresponding to the operating amounts of the operation devices, regardless of the loads on the hydraulic actuators. In addition, since each pressure compensation valve moves in accordance with the highest load pressure, the discharge pressure of the pump can be always kept higher than the highest load pressure, so long as the sum of the control valve required flow rate/rates and the unloading flow rate does not exceed the maximum discharge flow rate of the pump.

The at least one operation device may include a first operation device and a second operation device. The at least one control valve may include a first control valve corresponding to the first operation device and a second control valve corresponding to the second operation device. When the first operation device and the second operation device are operated concurrently, the controller may determine a first control valve required flow rate such that the first control valve required flow rate is proportional to the meter-in opening area of the first control valve, determine a second control valve required flow rate such that the second control valve required flow rate is proportional to the meter-in opening area of the second control valve, and control the regulator such that the discharge flow rate of the pump is a sum of the first control valve required flow rate, the second control valve required flow rate, and the unloading flow rate. According to this configuration, when the first operation device and the second operation device are operated concurrently, the pressure difference between the upstream-side pressure and the downstream-side pressure of the meter-in opening can be kept constant for each of the first and second control valves, so long as the sum of the control valve required flow rates and the unloading flow rate does not exceed the maximum discharge flow rate of the pump.

Advantageous Effects of Invention

The present invention makes it possible to suppress wasteful energy consumption when the operating amount of the operation device is less than the maximum amount.

DESCRIPTION OF EMBODIMENTS

Figure 1:
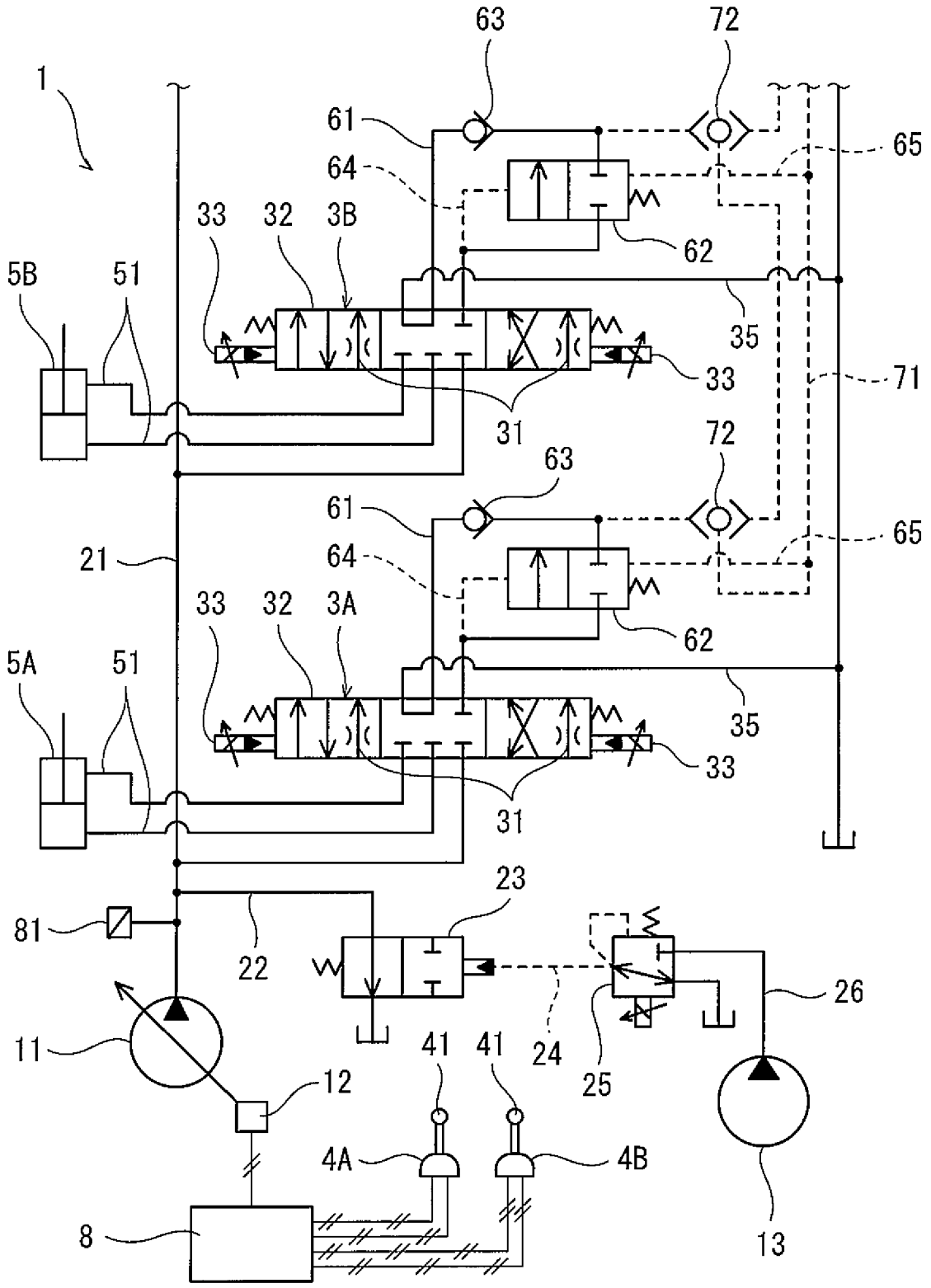
FIG. 1 shows a schematic configuration of a hydraulic system according to one embodiment of the present invention.

FIG. 1 shows a hydraulic system 1 according to one embodiment of the present invention. For example, the hydraulic system 1 is installed in a construction machine, such as a hydraulic excavator or a hydraulic crane, or in a civil engineering machine, an agricultural machine, or an industrial machine.

Specifically, the hydraulic system 1 includes: two hydraulic actuators (a first hydraulic actuator 5A and a second hydraulic actuator 5B); and a main pump 11, which supplies hydraulic oil to the first and second hydraulic actuators 5A and 5B. The hydraulic system 1 further includes a first control valve 3A and a second control valve 3B. The first control valve 3A is interposed between the first hydraulic actuator 5A and the main pump 11. The second control valve 3B is interposed between the second hydraulic actuator 5B and the main pump 11. It should be noted that the number of sets of a hydraulic actuator and a control valve may be three or more.

The main pump 11 is driven by an unshown engine. The engine also drives an auxiliary pump 13. The main pump 11 is a variable displacement pump (a swash plate pump or a bent axis pump) whose tilting angle is changeable. The tilting angle of the main pump 11 is adjusted by a regulator 12.

The main pump 11 is connected to the first and second control valves 3A and 3B by a supply line 21. The discharge pressure of the main pump 11 is kept to a relief pressure or lower by an unshown relief valve.

In the present embodiment, the first and second hydraulic actuators 5A and 5B are double-acting cylinders, and each of the first and second control valves 3A and 3B is connected to the first hydraulic actuator 5A or the second hydraulic actuator 5B by a pair of supply/discharge lines 51. However, one or each of the first and second hydraulic actuators 5A and 5B may be a single-acting cylinder, and the control valve (3A or 3B) may be connected to the hydraulic actuator (5A or 5B) by a single supply/discharge line 51. Alternatively, one or each of the first and second hydraulic actuators 5A and 5B may be a hydraulic motor.

Both ends of each of pressure compensation lines 61 are connected to a corresponding one of the first and second control valves 3A and 3B. Tank lines 35 are also connected to the first and second control valves 3A and 3B, respectively.

As a result of a first operation device 4A being operated, the position of the first control valve 3A is switched from a neutral position to a first position (a position for moving the first hydraulic actuator 5A in one direction) or to a second position (a position for moving the first hydraulic actuator 5A in a direction opposite to the one direction). Similarly, as a result of a second operation device 4B being operated, the position of the second control valve 3B is switched from a neutral position to a first position (a position for moving the second hydraulic actuator 5B in one direction) or to a second position (a position for moving the second hydraulic actuator 5B in a direction opposite to the one direction.

When each of the first and second control valves 3A and 3B is in the neutral position, the corresponding pair of supply/discharge lines 51 and the supply line 21 are blocked. When the control valve is in the first position or the second position, the supply line 21 communicates with one of the supply/discharge lines 51 via the pressure compensation line 61, and the other supply/discharge line 51 communicates with the tank line 35. In each of the first and second control valves 3A and 3B, a meter-in opening 31 interposed between the supply line 21 and the upstream end of the pressure compensation line 61 functions as a restrictor.

The pressure compensation lines 61 are provided with pressure compensation valves 62, respectively. Specifically, each of the pressure compensation valves 62 is positioned downstream of the meter-in opening 31 of a corresponding one of the first and second control valves 3A and 3B. Each pressure compensation line 61 is further provided with a check valve 63 positioned between the pressure compensation valve 62 and the downstream end of the pressure compensation line 61.

Each pressure compensation valve 62 moves in accordance with the highest load pressure between the load pressure of the first hydraulic actuator 5A and the load pressure of the second hydraulic actuator 5B, and keeps constant the pressure difference between the highest load pressure and the downstream-side pressure of the corresponding meter-in opening 31. To be more specific, the hydraulic system 1 is provided with a highest load pressure detection line 71 for detecting the highest load pressure. The highest load pressure detection line 71 includes a plurality of high pressure selective valves 72, and is connected to the pressure compensation lines 61 between the pressure compensation valves 62 and the check valves 63. The downstream-side pressure of each meter-in opening 31 is led to the corresponding pressure compensation valve 62 through a first pilot line 64, and also, the highest load pressure is led to each pressure compensation valve 62 through a second pilot line 65.

In the present embodiment, each of the first and second control valves 3A and 3B includes a spool 32 and a pair of drive units 33. Each of the drive units 33 drives the spool 32 in accordance with an electrical signal. For example, each of the drive units 33 may be a solenoid proportional valve connected to a pilot port of the control valve (3A or 3B), or may be an electric actuator that pushes the spool 32.

Each of the first and second operation devices 4A and 4B includes an operating unit 41, and outputs an operation signal corresponding to an operating amount of the operating unit 41. That is, the operation signal outputted from each operation device increases in accordance with increase in the operating amount. The operating unit 41 may be, for example, an operating lever. Alternatively, the operating unit 41 may be a foot pedal or the like.

In the present embodiment, each of the first and second operation devices 4A and 4B is an electrical joystick that outputs an electrical signal as the operation signal. However, as an alternative, each of the first and second operation devices 4A and 4B may be a pilot operation valve that outputs a pilot pressure as the operation signal. In this case, the drive units 33 may be eliminated from each of the first and second control valves 3A and 3B, and the pilot pressure outputted from each of the first and second operation devices 4A and 4B may be led to a pilot port of the corresponding control valve.

The operation signal (electrical signal) outputted from each of the first and second operation devices 4A and 4B is inputted to a controller 8. For example, the controller 8 includes a CPU and memories such as a ROM and RAM, and the CPU executes a program stored in the ROM.

Figure 2:
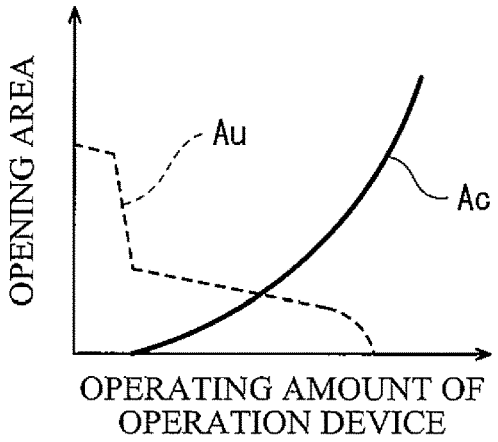
FIG. 2 is a graph showing a relationship of the meter-in opening area of a control valve and the opening area of an unloading valve to the operating amount of an operating unit of an operation device.

As shown in FIG. 2, the controller 8 feeds the electrical signal to one drive unit 33 of the first control valve 3A, such that the meter-in opening area Ac of the first control valve 3A increases in accordance with increase in the operation signal outputted from the first operation device 4A. Similarly, the controller 8 feeds the electrical signal to one drive unit 33 of the second control valve 3B, such that the meter-in opening area Ac of the second control valve 3B increases in accordance with increase in the operation signal outputted from the second operation device 4B. The meter-in opening area Ac changes in a curvilinear manner (convex downward), such that the increase rate of the meter-in opening area Ac increases in accordance with increase in the operation signal (the operating amount of the operation device (4A or 4B)).

It should be noted that it is not essential that the meter-in opening area Ac of the first control valve 3A or the second control valve 3B be curved over the entire range, but may be, for example, partly straight near the maximum value of the operation signal.

An unloading line 22 is branched off from the aforementioned supply line 21. The unloading line 22 is provided with an unloading valve 23. The unloading valve 23 defines an unloading flow rate Qu, at which the hydraulic oil discharged from the main pump 11 is released to a tank. In the illustrated example, the unloading valve 23 is disposed upstream of all the control valves. However, as an alternative, the unloading valve 23 may be disposed downstream of all the control valves.

In the present embodiment, the unloading valve 23 includes a pilot port, and the opening area Au of the unloading valve 23 decreases from a fully opened state toward a fully closed state in accordance with increase in pilot pressure. Alternatively, the unloading valve 23 may be a solenoid-driven valve.

The pilot port of the unloading valve 23 is connected to a secondary pressure port of a solenoid proportional valve 25 by a secondary pressure line 24. A primary pressure port of the solenoid proportional valve 25 is connected to the aforementioned auxiliary pump 13 by a primary pressure line 26. The discharge pressure of the auxiliary pump 13 is kept to a setting pressure by an unshown relief valve.

As shown in FIG. 2, the controller 8 feeds a command current to the solenoid proportional valve 25, such that the opening area Au of the unloading valve 23 decreases in accordance with increase in the operation signal outputted from each of the first and second operation devices 4A and 4B. Accordingly, as shown in FIG. 3, the unloading flow rate Qu also decreases in accordance with increase in the operation signal outputted from each of the first and second operation devices 4A and 4B.

The aforementioned regulator 12 is moved by an electrical signal. For example, in a case where the main pump 11 is a swash plate motor, the regulator 12 may electrically change the hydraulic pressure applied to a spool coupled to the swash plate of the main pump 11, or may be an electric actuator coupled to the swash plate of the main pump 11.

Figure 4:
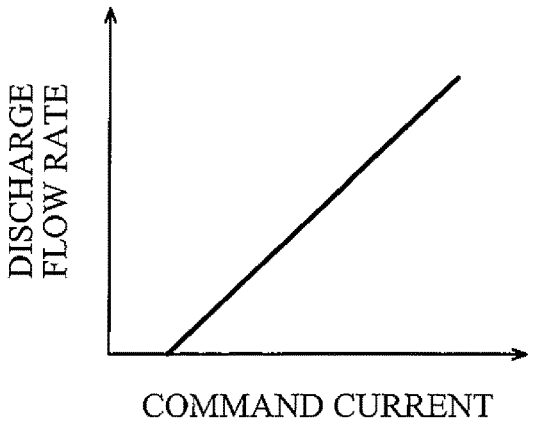
FIG. 4 is a graph showing a relationship between a command current to a regulator and a pump discharge flow rate.

A command current is fed from the controller 8 to the regulator 12. As shown in FIG. 4, the discharge flow rate (tilting angle) of the main pump 11 changes linearly in proportion to the command current. A map indicating a relationship between the command current and the discharge flow rate of the main pump 11, the map being shown in FIG. 4, is prestored in the controller 8.

Figure 3:
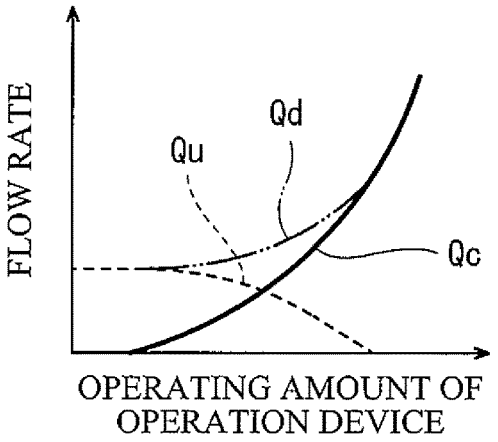
FIG. 3 is a graph showing a relationship of a control valve required flow rate and an unloading flow rate to the operating amount of the operating unit of the operation device.

A map indicating a relationship between the operating amount of the operation device and the unloading flow rate Qu, the map being shown in FIG. 3, is also stored in the controller 8. However, the map relating to the unloading flow rate Qu is not essential, and the unloading flow rate Qu may be calculated as needed based on an equation shown below by using the opening area Au of the unloading valve 23 and the discharge pressure Pd of the main pump 11.

$$Qu = C \times Au \times \sqrt{Pd} \quad (C\text{: coefficient})$$

A map indicating a relationship between the operating amount of the operation device (4A or 4B) and a control valve required flow rate Qc, the map being shown in FIG. 3, is also prestored in the controller 8 for each of the first and second control valves 3A and 3B. The control valve required flow rate Qc is proportional to the meter-in opening area of the control valve (3A or 3B).

Figure 5:
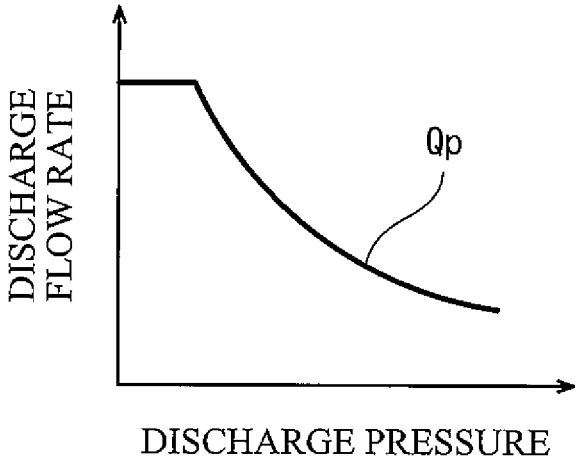
FIG. 5 is a graph showing a horsepower control flow rate.
Figure 6:
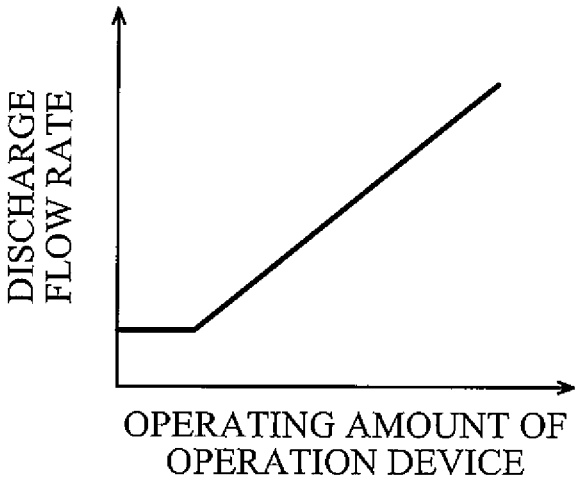
FIG. 6 is a graph showing a relationship between the operating amount of an operation device and a pump discharge flow rate in a conventional hydraulic system.

In the present embodiment, the controller 8 also performs horsepower control. For this reason, a map indicating a relationship between the discharge pressure of the main pump 11 and a horsepower control flow rate Qp, the map being shown in FIG. 5, is also prestored in the controller 8. The controller 8 is electrically connected to a pressure sensor 81. The pressure sensor 81 measures the discharge pressure Pd of the main pump 11.

Next, control of the regulator 12 performed by the controller 8 is described for the following two cases separately: a case where either the first operation device 4A or the second operation device 4B is operated alone (single operation); and a case where both the first operation device 4A and the second operation device 4B are operated concurrently (combined operation).

<Single Operation>

Hereinafter, a case where the first operation device 4A is operated alone is described as a representative example. Of course, the description below is similarly applied to a case where the second operation device 4B is operated alone.

When the first operation device 4A is operated, the controller 8 controls the first control valve 3A such that the meter-in opening area Ac is adjusted so as to correspond to the operation signal outputted from the first operation device 4A, and determines the control valve required flow rate Qc corresponding to the operation signal outputted from the first operation device 4A by using the map relating to the control valve required flow rate Qc shown in FIG. 3. The controller 8 also determines the unloading flow rate Qu corresponding to the operation signal outputted from the first operation device 4A by using the map relating to the unloading flow rate Qu shown in FIG. 3.

Thereafter, the controller 8 sums the control valve required flow rate Qc and the unloading flow rate Qu to calculate a discharge flow rate Qd of the main pump 11 (Qd=Qc+Qu), and determines a command current corresponding to the discharge flow rate Qd by using the map shown in FIG. 4. Then, the controller 8 feeds the determined command current to the regulator 12. That is, the controller 8 controls the regulator 12, such that the discharge flow rate Qd of the main pump 11 is the sum of the control valve required flow rate Qc and the unloading flow rate Qu.

When the discharge flow rate Qd of the main pump 11 is calculated by summing the control valve required flow rate Qc and the unloading flow rate Qu, if the calculated discharge flow rate Qd is higher than the horsepower control flow rate Qp corresponding to the discharge pressure Pd measured by the pressure sensor 81, the horsepower control flow rate Qp being shown in FIG. 5, the controller 8 determines a command current corresponding to the horsepower control flow rate Qp by using the map shown in FIG. 4. Then, the controller 8 feeds the determined command current to the regulator 12. That is, the controller 8 controls the regulator 12, such that the discharge flow rate Qd of the main pump 11 is the horsepower control flow rate QP.

In a case where the horsepower control is not performed, if the unloading flow rate Qu is not taken into account, when the first operation device 4A is operated, the discharge flow rate Qd of the main pump 11 changes at the same change rate as that of the meter-in opening area Ac of the first control valve 3A. That is, regardless of the operating amount of the first operation device 4A, the discharge flow rate Qd of the main pump 11 will not become excessively high relative to the meter-in opening area of the first control valve 3A. Thus, according to the hydraulic system 1 of the present embodiment, wasteful energy consumption can be suppressed when the operating amount of the first operation device 4A is less than the maximum operating amount.

The control valve required flow rate Qc, which is obtained by subtracting the unloading flow rate Qu from the discharge flow rate Qd of the main pump 11, is also a flow rate passing through the meter-in opening 31 of the first control valve 3A. Since the control valve required flow rate Qc is proportional to the meter-in opening area Ac, a value V (V=Qc/Ac) obtained by dividing the control valve required flow rate Qc by the meter-in opening area Ac is constant. The square ($V^2$) of the value V obtained by dividing the control valve required flow rate by the meter-in opening area is proportional to the pressure difference between the upstream-side pressure and the downstream-side pressure of the meter-in opening 31. That is, in the present embodiment, the pressure difference between the upstream-side pressure and the downstream-side pressure of the meter-in opening 31 can be kept constant. Therefore, even though the hydraulic system 1 is of an electrical positive control type, the same control as in a case where the hydraulic system 1 is of a load-sensing type can be performed.

Accordingly, compared to a conventional load-sensing type hydraulic system, in which the highest load pressure is led to the regulator, the hydraulic system 1 of the present embodiment has the following advantages.

(1) Since the valve unit including the first and second control valves 3A and 3B is normally disposed away from the main pump 11 and the regulator 12, a pipe for leading the highest load pressure from the valve unit to the regulator is unnecessary.

(2) The structure of the regulator 12 is simple.

(3) In order to perform horsepower control, a conventional load-sensing type hydraulic system requires a mechanical configuration dedicated for the horsepower control, whereas the hydraulic system of the present embodiment is capable of performing the horsepower control electronically.

(4) In order to change the pressure difference between the pump discharge pressure and the highest load pressure, a conventional load-sensing type hydraulic system requires a mechanical configuration dedicated for changing the pressure difference, whereas the hydraulic system of the present embodiment is capable of changing the pressure difference electronically. Particularly in the present embodiment, the pressure difference can be readily changed in accordance with the rotational speed of the unshown engine.

(5) In order to change the load-dependent property (the property of changing the flow rate of pressure oil fed to an actuator in accordance with the magnitude of load pressure), a conventional load-sensing type hydraulic system requires changing the diameter of a compensation piston included in a control valve, whereas the hydraulic system of the present embodiment is capable of readily changing the load-dependent property electronically.

(6) When an abnormal phenomenon in the behavior of a hydraulic actuator, such as hunting, occurs in a conventional load-sensing type hydraulic system, it has been difficult to address the abnormal phenomenon, whereas in the present embodiment, since the abnormal phenomenon can be detected based on the discharge pressure of the main pump 11, the occurrence of the abnormal phenomenon can be readily suppressed by controlling the discharge flow rate of the main pump 11.

It should be noted that when either the first operation device 4A or the second operation device 4B is operated alone, the pressure compensation valve 62 does not serve an important role.

<Combined Operation>

When the first operation device 4A and the second operation device 4B are operated concurrently, the controller 8 uses the map shown in FIG. 3, the map relating to the first control valve 3A, to determine a first control valve required flow rate Qc1 such that the first control valve required flow rate Qc1 is proportional to the meter-in opening area Ac of the first control valve 3A, and also, uses the map shown in FIG. 3, the map relating to the second control valve 3B, to determine a second control valve required flow rate Qc2 such that the second control valve required flow rate Qc2 is proportional to the meter-in opening area Ac of the second control valve 3B. Then, the controller 8 controls the regulator 12, such that the discharge flow rate Qd of the main pump 11 is the sum of the first control valve required flow rate Qc1, the second control valve required flow rate Qc2, and the unloading flow rate Qu.

For example, in a case where the load pressure PL1 of the first hydraulic actuator 5A is the highest load pressure, the pressure compensation valve 62 provided downstream of the meter-in opening 31 of the second control valve 3B compensates for the pressure difference ΔP (=PL1−PL2) between the load pressure PL1 of the first hydraulic actuator 5A and the load pressure PL2 of the second hydraulic actuator 5B.

In a case where no pressure compensation valve 62 is installed, when the first operation device 4A and the second operation device 4B are operated concurrently, the supply of the hydraulic oil is concentrated to the hydraulic actuator (5A or 5B) with a lower load. On the other hand, in a case where the pressure compensation valves 62 are installed, when the first and second operation devices 4A and 4B are operated concurrently, the hydraulic oil can be supplied to the first and second hydraulic actuators 5A and 5B in respective distribution amounts corresponding to the operating amounts of the first and second operation devices 4A and 4B, regardless of the loads on the first and second hydraulic actuators 5A and 5B. In addition, since each pressure compensation valve 62 moves in accordance with the highest load pressure, the discharge pressure of the main pump 11 can be always kept higher than the highest load pressure, so long as the sum of the first control valve required flow rate Qc1, the second control valve required flow rate Qc2, and the unloading flow rate Qu does not exceed the maximum discharge flow rate of the main pump 11.

Further, in the present embodiment, the discharge flow rate Qd of the main pump 11 is the sum of the first control valve required flow rate Qc1, the second control valve required flow rate Qc2, and the unloading flow rate Qu. Accordingly, when the first operation device 4A and the second operation device 4B are operated concurrently, the pressure difference between the upstream-side pressure and the downstream-side pressure of the meter-in opening 31 can be kept constant for each of the first and second control valves 3A and 3B, so long as the sum (Qc1+Qc2+Qu) does not exceed the maximum discharge flow rate of the main pump 11.

(Variations)

The present invention is not limited to the above-described embodiment. Various modifications can be made without departing from the spirit of the present invention.

For example, the number of sets of a hydraulic actuator, a control valve, and an operation device need not be plural, but may be one. In this case, the pressure compensation valves 62 are unnecessary.

The horsepower control need not be performed. In this case, the pressure sensor 81 is unnecessary.

REFERENCE SIGNS LIST

1 hydraulic system
11 main pump
12 regulator
23 unloading valve
3A, 3B control valve
31 meter-in opening
4A, 4B operation device
41 operating unit
5A, 5B hydraulic actuator
62 pressure compensation valve
8 controller

The invention claimed is:

1. A hydraulic system comprising:

at least one operation device that outputs an operation signal corresponding to an operating amount of an operating device;

a variable displacement pump that supplies hydraulic oil to at least one hydraulic actuator;

at least one control valve interposed between the hydraulic actuator and the variable displacement pump, the control valve changing a meter-in opening area of the control valve, such that an increase rate of the meter-in opening area increases in accordance with an increase in the operation signal outputted from the operation device;

a regulator that adjusts a tilting angle of the variable displacement pump;

an unloading valve that defines an unloading flow rate, at which the hydraulic oil discharged from the variable displacement pump is released to a tank; and a controller that, when the operation device is operated, determines a control valve required flow rate such that (i) the control valve required flow rate changes at a same change rate as a change rate of the meter-in opening area of the control valve and (ii) a value obtained by dividing the control valve required flow rate by the meter-in opening area is constant, and controls the regulator such that a discharge flow rate of the variable displacement pump is equal to a sum of the control valve required flow rate and the unloading flow rate.

2. The hydraulic system according to claim 1, wherein:

the at least one operation device includes a plurality of operation devices, the at least one hydraulic actuator includes a plurality of hydraulic actuators, the at least one control valve includes a plurality of control valves, and the hydraulic system further comprises a plurality of pressure compensation valves, each pressure compensation valve of the plurality of pressure compensation valves being provided downstream of a meter-in opening of a corresponding one of the plurality of control valves, the meter-in opening functioning as a restrictor of the corresponding control valve, each pressure compensation valve keeping constant a pressure difference between a downstream-side pressure of the meter-in opening and a highest load pressure among load pressures of the plurality of respective hydraulic actuators.

3. The hydraulic system according to claim 2, wherein the plurality of operation devices include a first operation device and a second operation device, the plurality of control valves include a first control valve corresponding to the first operation device and a second control valve corresponding to the second operation device, and when the first operation device and the second operation device are operated concurrently, the controller:

determines a first control valve required flow rate such that the first control valve required flow rate is proportional to the meter-in opening area of the first control valve, determines a second control valve required flow rate such that the second control valve required flow rate is proportional to the meter-in opening area of the second control valve, and controls the regulator such that the discharge flow rate of the pump is a sum of the first control valve required flow rate, the second control valve required flow rate, and the unloading flow rate.

* * * * *